United States Patent [19]

Leifeld

[11] Patent Number: 4,723,344

[45] Date of Patent: Feb. 9, 1988

[54] METHOD AND APPARATUS FOR OPENING FIBER BALES

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 849,297

[22] Filed: Apr. 8, 1986

[30] Foreign Application Priority Data

Apr. 13, 1985 [DE] Fed. Rep. of Germany ..... 3513295

[51] Int. Cl.[4] ..... D01H 5/38

[52] U.S. Cl. ..... 19/105; 19/80 R; 19/97.5

[58] Field of Search ..... 19/105, 80 R, 79.5, 19/240, 300, 66 R

[56] References Cited

U.S. PATENT DOCUMENTS

| | | | |
|---|---|---|---|
| 3,667,087 | 6/1972 | Dakin et al. | 19/105 |
| 3,728,759 | 4/1973 | Hergeth | 19/105 |
| 4,498,215 | 2/1985 | Hergeth et. al. | 19/97.5 X |
| 4,535,511 | 8/1985 | Leifeld | 19/105 |
| 4,587,691 | 5/1986 | Hösel | 19/80 R |

FOREIGN PATENT DOCUMENTS

| | | | |
|---|---|---|---|
| 93235 | 2/1983 | European Pat. Off. . | |
| 1160652 | 1/1965 | Fed. Rep. of Germany . | |
| 2031788 | 2/1972 | Fed. Rep. of Germany . | |
| 3120133 | 12/1982 | Fed. Rep. of Germany . | |
| 1131802 | 10/1968 | United Kingdom | 19/105 |
| 2127446 | 4/1984 | United Kingdom | 19/105 |

OTHER PUBLICATIONS

E. Schloz, "ITMA 83—Spinnereivorbereitung Rückblick und Tendenzen", Textil Praxis International, Jan. 1984, No. 1744, vol. 1, pp. 15, 16.

*Primary Examiner*—Louis K. Rimrodt
*Assistant Examiner*—J. L. Olds
*Attorney, Agent, or Firm*—Spencer & Frank

[57] ABSTRACT

A method of processing textile fiber includes the steps of removing fiber tufts from fiber bale tops by a fiber bale opening device by effecting a travel of the opening device back-and-forth above serially arranged fiber bales to execute consecutive opening passes; lowering the opening device prior to each opening pass for adapting the opening device to the height level of the fiber bale tops; introducing the fiber tufts removed by the bale opener into a fiber storage device; conveying the fiber tufts from the fiber storage device to a successive processing station; and varying the duration of the opening passes by varying the travelling speed of the opening device. The travelling speed is varied as a function of a fiber quantity requirement by a fiber processing machine forming part of a fiber processing line and being supplied by fiber, at least indirectly, by the fiber bale opening device.

22 Claims, 2 Drawing Figures

METHOD AND APPARATUS FOR OPENING FIBER BALES

BACKGROUND OF THE INVENTION

This invention relates to a fiber processing line and concerns in particular a method and an apparatus for opening fiber bales placed on a supporting surface in a fiber processing (spinning) plant. The opening (tuft removing) device of a bale opener is moved back and forth above the fiber bales and is, before each pass, lowered for working on the top face of the fiber bale, and the removed fiber tufts are introduced in a storage device from which the tufts are conveyed to a successive processing station. The change in the duration of passes of the opening device is effected by varying the travelling speed of the carriage (trolley) which forms part of the bale opener and which supports the opening device.

According to a known process, a feed adaptation (that is, the adaptation of the vertical thickness of the fiber layer to be removed from the bale top) is effected based on a division of the operation of the opening device into standstill and working periods. A change of the feed adaptation as a function of the maximum or minimum quantity level of the fiber material in the storage device is technologically disadvantageous. The range in which the adaptation may be effected is very small and the fiber output becomes irregular. In order to ensure a uniform fiber quantity removal from the fiber bales, in case of longer standstill periods a greater vertical feed has to be selected which results in larger tufts, whereby a smaller number of passes is required. Conversely, in case of shorter standstill periods, a smaller vertical feed has to be chosen which results in tufts of smaller dimensions requiring an increase of the number of passes. In this manner a compensation for the different densities of the fiber bale in the upper, middle and lower bale zones is sought to be achieved. It is a disadvantage of this process that there is a dependency from a maximum or, as the case may be, a minimum level measurement in the storage device which leads to an inflexibility of the opening process, so that an optimal efficiency of the opening process cannot be achieved.

SUMMARY OF THE INVENTION

It is an object of the invention to provide an improved method and apparatus of the above-outlined type with which an optimal efficiency of the fiber bale opening process can be achieved.

This object and others to become apparent as the specification progresses, are accomplished by the invention, according to which, briefly stated, the travelling speed of the opening device is altered as a function of the fiber requirement of subsequent fiber processing machines (that is, machines which are situated downstream of the bale opener in a fiber processing line), such as a storage device, a card feeder and carding machines.

In practicing the invention as outlined above, the range in which the horizontal travelling speed of the opening device can be varied is relatively large, and the variations are effected with a relatively high sensitivity in a practically delay-free manner. The adaptation of the travelling speed to the fiber material quantity required by the subsequent fiber processing machines or storage devices results in a particularly flexible mode of operation. By virtue of the fact that a direct and immediate adaptation occurs, there is achieved an optimal efficiency of the opening process. The required fiber quantities (actual quantity requirement) may be determined by computed magnitudes or by the fill level of the storage device.

Advantageously, the horizontal travelling speed of the opening device and thus the fiber quantities to be removed is made dependent from the determined fiber quantity requirement of the subsequent cleaning machine or cleaning machine group. Preferably, the fiber quantity requirement by other processing machines such as carding machines, openers, cleaners and the like is determined based on the current consumption of their feed aggregates (drives), and the determined magnitude or its integral value serves as a setting magnitude for a regulator, by means of which the travelling speed of the carriage (on which the opening device is mounted) is controlled. Expediently, the fiber level in a storage device of, for example, a cleaning and opening device is determined by determining the height level of the material in the storage device by means of an optical barrier or ascertaining the quantities by means of a weighing device, and dependent upon a deviation from a mean level value in the storage device as a desired value, the travelling speed of the carriage is continuously controlled. Preferably, an optimal switch-on period of the cleaning apparatus of, for example, 90–95% is taken as a desired value, and an actual working period a of the cleaning device is determined within a given time b, for example, 10 or 15 minutes, and the travelling speed of the carriage with the opening device is controlled according to the ratio a/b by means of a regulator or similar device.

For performing the above-outlined method, the invention further encompasses an apparatus which comprises a regulating and control device, whose input is connected with a measuring member for determining the fiber quantities actually processed by subsequent processing machines and whose output is connected with the carriage drive of the bale opener. The basic speed load may be determined by a computer based on the card output. The regulating magnitude may be determined from a measurement of the material level in one or more storage devices which are associated with fiber processing machines connected downstream of the bale opener as viewed in the direction of successive fiber processing. The measuring member is preferably associated with the fiber storage device which is immediately downstream of the bale opener. As measuring devices, pressure sensitive switches, analog pressure switches or photocell chains may be used. Preferably, an analog (stepless) measuring component is used, or it may be expedient to use a multi-stage measuring member with two or more stages. Dependent upon whether the fiber requirement (that is, the fiber withdrawal from the storage device) is analog or step-wise, the travelling speed of the carriage for the opening device is varied steplessly or in steps. In a stepless adaptation of the travelling speed, the output change becomes immediately effective.

The travelling speed of the carriage may be varied in different ways. The carriage may move continuously, that is, a continuous removal of fiber material from the bale is effected. It may also perform according to a "stop-and-go" working method in which the change or adaptation of the travelling speed is effected only during the "go" phase.

Expediently, the input of the regulating and control device is connected with the drives of cards or card feeders. Preferably, the drives for the cards or card feeders are connected with the desired value setter of the regulating and control device. According to a further feature of the invention, a computer is connected between the driving devices of the cards or card feeder and the regulating and control device. Such a computer may be e. g. Trützschler Microcomputer TMS, manufactured by Trützschler GmbH & Co. KG, D-4050 Mönchengladbach 3.

DESCRIPTION OF THE PREFERRED EMBODIMENTS

Figure 1:
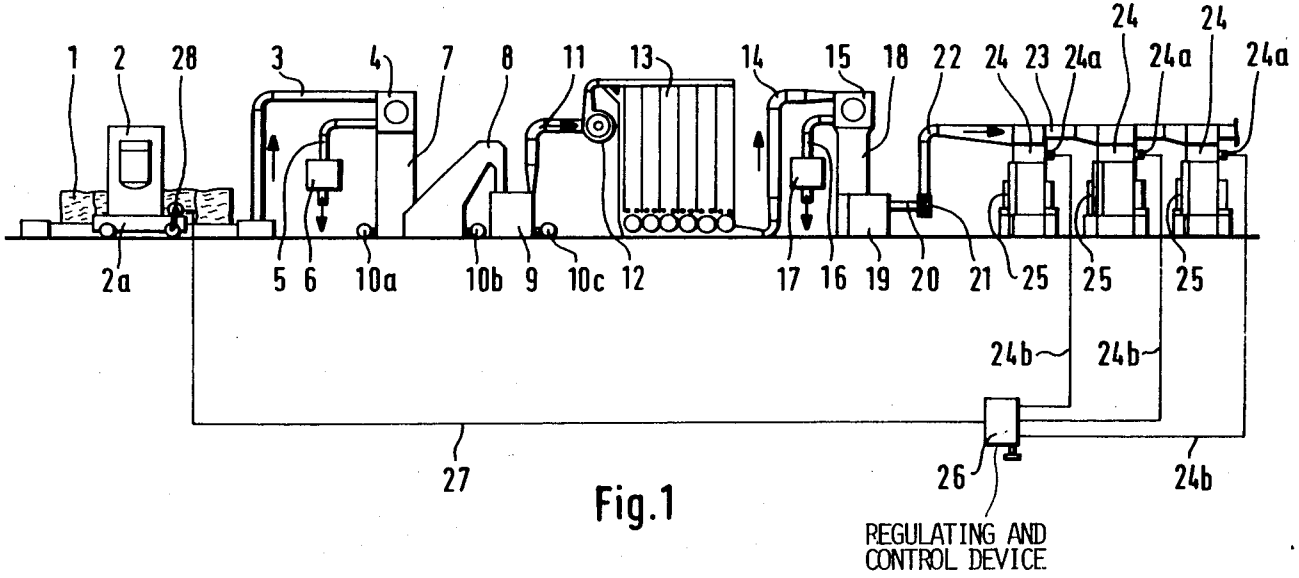
FIG. 1 is a diagrammatic and schematic side elevational view of a fiber processing line incorporating a preferred embodiment of the invention.

Turning to FIG. 1, there is shown therein a fiber cleaning line, the individual machines of which are serially connected to one another by ducts. A row of serially arranged, free standing fiber bales 1 are opened by a bale opener 2 which may be a "BLENDOMAT" model, manufactured by Trützschler GmbH & Co. KG, Mönchengladbach, Federal Republic of Germany. The fiber tufts removed from the top of the fiber bales 1 by an opening device 2*b* (shown only in FIG. 2) of the travelling bale opener 2 are pneumatically conveyed in a duct 3 to a condenser 4 which separates the fiber tufts from the conveying air stream. The latter, after passing through a tubular conduit 5 and a filter 6, is released into the fiber cleaning hall. To the condenser 4 there is connected, downstream thereof, a charging device 7 with feed chute (storage device) for a multi-stage cleaner 8 which is followed by a cleaner 9, such as a sawtooth cleaner. At the lower end of the charging device 7, the multi-stage cleaner 8 and the cleaner 9, waste conduits 10*a*, 10*b* and 10*c* are provided. The cleaner 9 is connected by means of a duct 11 with the suction side of a transport fan 12 which is followed by a mixer 13 which may be a multiple mixer including a plurality of chambers. To the mixer 3 there is connected, downstream thereof and by means of a duct 14, a condenser 15 which separates the fiber tufts from the conveying air stream. The latter, after passing through a duct 16 and a filter 17, is released into the cleaning hall. To the condenser 15 there is connected, downstream thereof, a fine opener 19 with the interposition of a charging device 18 with feed chute. From the fine opener 19 the fiber tufts are admitted through a duct 20 to the suction side of a transport fan 21. The output side of the transport fan 21 is connected to a duct 22 which leads into a distributor duct 23, connected to a plurality of card feeders 24 provided with feed chutes. These card feeders may be of the "EXACTAFEED" model, manufactured by Trützschler GmbH & Co. KG, Mönchengladbach, Federal Republic of Germany. From the card feeders 24 the fiber tufts are admitted in a compressed condition as a fiber lap to respective carding machines 25 which produce a sliver of parallelled fibers. The sliver is deposited in a coiler can from which the sliver is fed to a successive fiber processing machine, such as a drawing frame.

The control of the travelling speed of the bale opener 2 is effected as a direct function of the fiber requirement of the carding machines 25. Such requirement is determined, for example, based on the consumption of electric current of the card feeders 24. For this purpose, a tachogenerator 24*a* is connected to the drive motor for the opening rollers and the feed rollers associated with the card feeders. The determined electrical magnitude or its integral value serves as a measuring magnitude for a regulating and control device 26 which is connected to a carriage drive motor 28 by a conductor 27 for controlling the speed of the carriage 2*a* of the bale opener 2.

Figure 2:
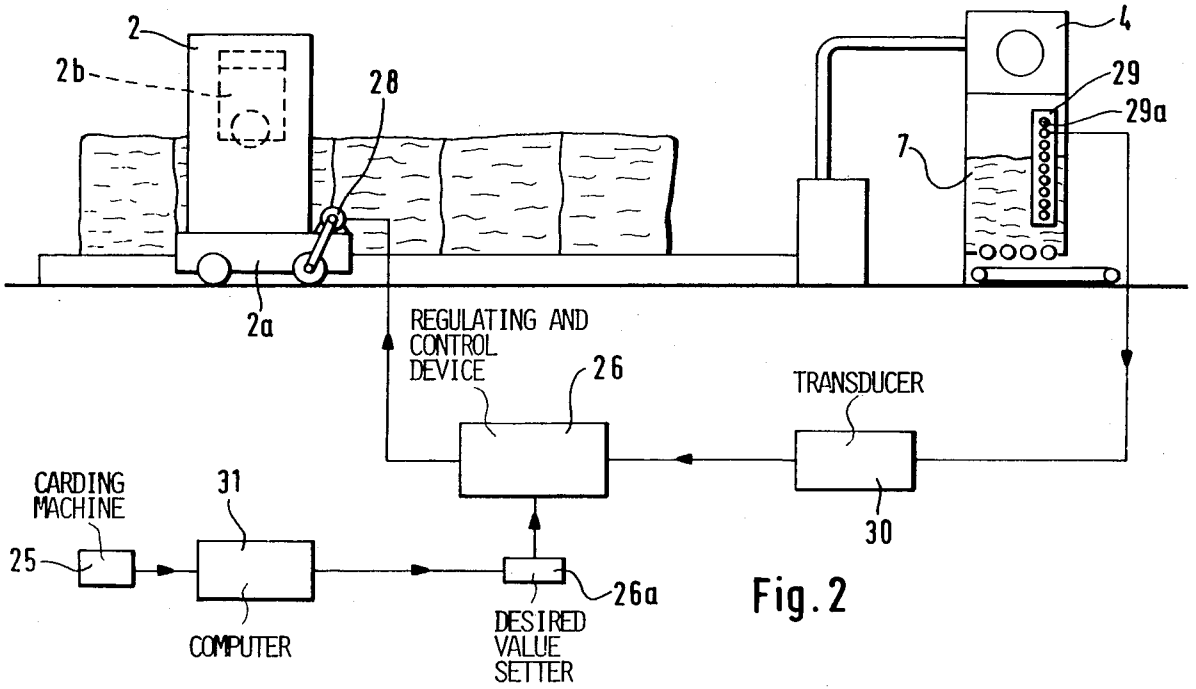
FIG. 2 is a block diagram, combined with a schematic side elevational view, of another preferred embodiment of the invention.

Turning now to FIG. 2, the required quantity output may also be determined as a function of the fiber level in an intermediate storage device, such as the storage device 7 of the multi-stage cleaner 8. Expediently, the fiber level in the storage device 7 is determined by a measuring device 29 operating with a plurality of sensors 29*a*, such as optical barriers or the like. It is also feasible to use a device with two sensors which sense the level between the two and which follow in an analog manner the rising or falling fiber level by corresponding displacement. The mean fiber level in the storage device 7 may be used as the desired value. Dependent upon the deviation from such desired value, the rpm of the drive motor 28 and thus the travel speed of the carriage 2*a* is controlled by the regulating and control device 26. Between the measuring device 29 and the regulating and control device 26 there is arranged a measuring value transducer 30. With the regulating and control device 26 there is associated a desired value setter 26*a* which is connected with a computer 31. The latter, in turn, is connected to carding machines 25, for example, to tachogenerators (not shown) thereof, which, in turn, are connected with the rollers or drives of the carding machines. According to another expedient preferred embodiment of the invention, the desired value setter may be manually set to follow a predetermined program.

It will be understood that the above description of the present invention is susceptible to various modifications, changes and adaptations, and the same are intended to be comprehended within the meaning and range of equivalents of the appended claims.

What is claimed is:

1. In a method of processing textile fiber, including the steps of removing fiber tufts from fiber bale tops by a fiber bale opening device by effecting a travel of the opening device back-and-forth above serially arranged fiber bales to execute consecutive opening passes; lowering the opening device prior to each opening pass for adapting the opening device to the height level of the fiber bale tops; introducing the fiber tufts removed by the bale opener into a fiber storage device; conveying the fiber tufts from said fiber storage device to a successive processing station; and varying the duration of the opening passes by varying the travelling speed of the opening device; the improvement wherein said travelling speed is varied as a function of a fiber quantity requirement by a fiber processing machine forming part of a fiber processing line and being supplied by fiber, at least indirectly, by said fiber bale opening device.

2. A method as defined in claim 1, wherein said travelling speed is varied as a function of a fiber quantity requirement by a cleaner constituting said fiber processing machine.

3. A method as defined in claim 1, wherein said travelling speed is varied as a function of a fiber quantity requirement by a cleaner group constituting said fiber processing machine.

4. A method as defined in claim 1, wherein the step of varying said travelling speed includes the steps of taking 90 to 95% of a switch-on duration of said fiber processing machine as a desired value; determining the actual work duration of the fiber processing machine within a predetermined period and controlling the travelling speed of the bale opening device by a regulator as a function of the ratio of said actual work duration to said predetermined period.

5. In a fiber processing line including a bale opener having a carriage arranged for a back-and-forth travel along fiber bales and an opening device supported on the carriage and moving therewith above the fiber bales for removing fiber tufts from top faces of the fiber bales; said fiber processing line comprises a plurality of fiber processing machines coupled at least indirectly to said bale opener for receiving at least indirectly fiber tufts therefrom; at least one of said fiber processing machines having a fiber tuft working means including current consuming drive means; the improvement comprising (a) current consumption determining means for determining an actual current consumption of said drive means;

(b) a regulating and control means connected to said current consumption determining means for receiving signals therefrom as a function of the current consumption; and (c) a carriage drive motor means connected to said regulating and control means for controlling the travelling speed of said carriage as a function of a fiber quantity requirement of said one fiber processing machine as represented by the current consumption thereof.

6. A fiber processing line as defined in claim 5, wherein said one fiber processing machine is a carding machine.

7. A fiber processing line as defined in claim 5, wherein said current consumption determining means comprises at least one tachogenerator.

8. A fiber processing line as defined in claim 5, wherein said one fiber processing machine is a carding machine having a carding drive and said storage device is a card feeder having a card feeder drive.

9. A fiber processing line as defined in claim 8, further comprising a desired value setter forming part of said regulating and control device; said desired value setter being connected to said carding drive.

10. A fiber processing line as defined in claim 8, further comprising a desired value setter forming part of said regulating and control device; said desired value setter being connected to said card feeder drive.

11. A fiber processing line as defined in claim 8, further comprising a computer connected between said regulating and control means and said carding drive.

12. A fiber processing line as defined in claim 8, further comprising a computer connected between said regulating and control means and said card feeder drive.

13. In a fiber processing line including a bale opener having a carriage arranged for a back-and-forth travel along fiber bales and an opening device supported on the carriage and moving therewith above the fiber bales for removing fiber tufts from top faces of the fiber bales; said fiber processing line comprises a plurality of fiber processing machines coupled at least indirectly to said bale opener for receiving at least indirectly fiber tufts therefrom; at least one of said fiber processing machines having a fiber tuft feeding means including a storage device containing fiber tufts whose quantity in the storage device is a function of the fiber quantity requirement by said one fiber processing machine; the improvement comprising (a) measuring means for measuring the fiber quantity in said storage device and for emitting a signal representing said fiber quantity;

(b) a regulating and control means having an input connected to said measuring means for receiving said signal and an output; and (c) a drive means for propelling said carriage; said drive means being connected to said output of said regulating and control means for varying the speed of said drive means to vary the travelling speed of said carriage as a function of the fiber quantity requirement of said one fiber processing machine.

14. A fiber processing line as defined in claim 13, wherein said measuring means is connected to said storage device.

15. A fiber processing line as defined in claim 13, wherein said measuring means comprises at least one photocell.

16. A fiber processing line as defined in claim 13, wherein said measuring means comprises an analog measuring member.

17. A fiber processing line as defined in claim 13, wherein said measuring means comprises an at least two-stage measuring member.

18. A fiber processing line as defined in claim 13, wherein said one fiber processing machine is a carding machine having a carding drive and said storage device is a card feeder having a card feeder drive.

19. A fiber processing line as defined in claim 18, further comprising a desired value setter forming part of said regulating and control device; said desired value setter being connected to said carding drive.

20. A fiber processing line as defined in claim 18, further comprising a desired value setter forming part of said regulating and control device; said desired value setter being connected to said card feeder drive.

21. A fiber processing line as defined in claim 18, further comprising a computer connected between said regulating and control means and said carding drive.

22. A fiber processing line as defined in claim 18, further comprising a computer connected between said regulating and control means and said card feeder drive.

* * * * *